US010468832B2

(12) United States Patent
Iizuka et al.

(10) Patent No.: US 10,468,832 B2
(45) Date of Patent: Nov. 5, 2019

(54) CONNECTOR

(71) Applicant: YAZAKI CORPORATION, Tokyo (JP)

(72) Inventors: Hayato Iizuka, Shizuoka (JP); Kazuma Kayo, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/945,615

(22) Filed: Apr. 4, 2018

(65) Prior Publication Data

US 2018/0294605 A1 Oct. 11, 2018

(30) Foreign Application Priority Data

Apr. 5, 2017 (JP) ..... 2017-075139

(51) Int. Cl.
*H01R 13/66* (2006.01)
*H01R 13/504* (2006.01)
(Continued)

(52) U.S. Cl.
CPC ..... *H01R 13/6633* (2013.01); *H01R 13/504* (2013.01); *H01R 13/5845* (2013.01);
(Continued)

(58) Field of Classification Search
CPC ..... H01R 13/6633; H01R 13/504; H01R 13/5845; H01R 13/6215
(Continued)

(56) References Cited

U.S. PATENT DOCUMENTS 5,264,814 A * 11/1993 Yamazaki ..... H01F 17/04 29/606
6,623,275 B1 * 9/2003 Pavlovic ..... H01R 13/7197 439/38
(Continued)

FOREIGN PATENT DOCUMENTS

CN 103515056 A 1/2014
CN 103797657 A 5/2014
(Continued)

OTHER PUBLICATIONS

Japanese Office Action for the related Japanese Patent Application No. 2017-075139 dated Apr. 2, 2019.
(Continued)

*Primary Examiner* — Alexander Gilman
(74) *Attorney, Agent, or Firm* — Kenealy Vaidya LLP

(57) ABSTRACT

A connector includes a conductor, a noise filter part, an inner mold part, and a housing. The conductor has a terminal at one end and the other end of the conductor is connected to a wire. The connector is to be joined with a counterpart connector so that the terminal is in conduction with a terminal of the counterpart connector. The noise filter part includes a core attached to the conductor and formed of a magnetic member which reduces noise of a current flowing in the conductor. The inner mold part is integrally molded with the noise filter part so as to cover at least a periphery of the core and formed of a soft resin material. The housing which covers a periphery of the inner mold part and is formed of a hard resin material.

7 Claims, 4 Drawing Sheets

(51) Int. Cl.

| | |
|---|---|
| ***H01R 13/621*** | (2006.01) |
| ***H01R 13/646*** | (2011.01) |
| ***H01R 13/58*** | (2006.01) |
| ***H01R 13/7193*** | (2011.01) |
| *H01R 11/12* | (2006.01) |

(52) U.S. Cl.
CPC ..... *H01R 13/6215* (2013.01); *H01R 13/646* (2013.01); *H01R 13/7193* (2013.01); *H01R 11/12* (2013.01)

(58) Field of Classification Search
USPC ..... 439/38
See application file for complete search history.

(56) References Cited

U.S. PATENT DOCUMENTS

| | | | | |
|---|---|---|---|---|
| 6,799,983 | B2 * | 10/2004 | Pavlovic | H01R 13/6485 439/181 |
| 6,837,732 | B2 * | 1/2005 | Pavlovic | H01R 13/7197 333/182 |
| 7,138,896 | B2 * | 11/2006 | Berens | H01F 17/06 336/83 |
| 7,307,495 | B2 * | 12/2007 | McLauchlan | H01R 4/2433 333/184 |
| 7,963,773 | B2 * | 6/2011 | Palli | H01R 13/6205 439/38 |
| 8,662,903 | B2 * | 3/2014 | Sasaki | H02K 9/26 439/38 |
| 9,172,178 | B2 * | 10/2015 | Isenhour | H01R 13/6205 |
| 9,653,843 | B2 * | 5/2017 | Suzuki | H01R 13/5221 |
| 2012/0190239 | A1 | 7/2012 | Shedletsky | |
| 2014/0141637 | A1 | 5/2014 | Miyakawa et al. | |
| 2014/0183995 | A1 | 7/2014 | Saitou et al. | |
| 2016/0056590 | A1 * | 2/2016 | Sugiyama | H01R 13/405 439/277 |
| 2018/0294605 | A1 * | 10/2018 | Iizuka | H01R 13/504 |

FOREIGN PATENT DOCUMENTS

| | | | |
|---|---|---|---|
| JP | 4-206904 | A | 7/1992 |
| JP | 2006-261578 | A | 9/2006 |
| JP | 2008-4328 | A | 1/2008 |
| JP | 2012-169143 | A | 9/2012 |
| JP | 2013-12437 | A | 1/2013 |
| JP | 2013-36394 | A | 2/2013 |

OTHER PUBLICATIONS

Chinese Office Action for the related Chinese Patent Application No. 201810288608.7 dated Apr. 17, 2019.

* cited by examiner

CONNECTOR

CROSS REFERENCE TO RELATED APPLICATIONS

This application claims priority from Japanese Patent Application No. 2017-075139 filed on Apr. 5, 2017, the entire contents of which are incorporated herein by reference.

BACKGROUND OF THE INVENTION

Field of the Invention

The invention relates to a connector.

A connector is known in which a ferrite core which is penetrated by each of needle-shaped terminals formed in a bus bar configuring a terminal metal fitting is received between an inner wall surface of an inner housing receiving chamber and an inner housing, and the ferrite core removes a noise of a circuit formed by connecting a terminal of a counterpart connector and the terminal metal fitting (see, for example, the patent document 1: JP-A-2013-12437).

[Patent Document 1] JP-A-2013-12437

According to a related art, a connector has a structure in which a ferrite core is fixed by being pinched between an inner wall surface of an inner housing receiving chamber and the inner housing. Thus, rattling may occur in the ferrite core, and the connector has a limitation in minimization.

SUMMARY

One or more embodiments provide a connector in which a core for noise reduction is held without rattling, and which can be minimized.

In order to achieve the above-described object, a connector according to the invention is characterized as follows (1) to (3).

In an aspect (1), one or more embodiments provide a connector including a conductor, a noise filter part, an inner mold part, and a housing. The conductor has a terminal at one end and the other end of the conductor is connected to a wire. The connector is to be joined with a counterpart connector so that the terminal is in conduction with a terminal of the counterpart connector. The noise filter part includes a core attached to the conductor and formed of a magnetic member which reduces noise of a current flowing in the conductor. The inner mold part is integrally molded with the noise filter part so as to cover at least a periphery of the core and formed of a soft resin material. The housing which covers a periphery of the inner mold part and is formed of a hard resin material.

According to the aspect (2), the core includes a pair of division cores having an annular shape. Joint surfaces of both ends of the pair of division cores are joined and combined with each other. The conductor has a winding part. One of the pair of division cores has a linear shape and passes through the winding parts and is provided with the conductors arranged in a row.

According to the aspect (3), the housing is integrally molded with the inner mold part so as to cover the periphery of the inner mold part.

In the aspect (1), the noise of the current flowing in the conductor can be reduced by the core formed of a magnetic member of the noise filter part. The inner mold part formed of a soft resin material is integrally molded to cover at least a periphery of the core of the noise filter part, and further the periphery is covered with the housing formed of a hard resin material. Thus, it is possible to prevent the rattling of the core formed of a magnetic member, and further to suppress the transmission of the external force to the core. Accordingly, the impact resistance of the core can be improved, and the durability with respect to the vibration or the impact during travelling and the like can be improved although the connector is mounted in the vehicle. In addition, since the noise filter part is covered with the inner mold part by the integral molding, the minimization can be achieved compared to a structure which is mounted with the inner housing molded separately. Further, since the inner mold part is brought into close contact with the core by the integral molding, the heat of the core can be excellently transmitted to the inner mold part, so as to improve the heat releasing property. In addition, since the inner mold part is a soft resin material, the mold pressure during the integral molding can be suppressed to alleviate the stress applied to the core during molding.

In the aspect (2), the division cores formed in a linear shape pass through the winding parts of the plurality of conductors, and the division cores are combined with each other. Thus, the plurality of conductors can be easily mounted in the annular core, so as to improve an assembly workability. Further, since the conductors are configured to be arranged in a row in the linear division core, a reduction in height can be achieved, so that the conductors can be installed in a narrow space.

In the aspect (3), since the housing is integrally molded to cover the periphery of the inner mold part, it is possible to prevent the rattling of the inner mold part with respect to the housing, and further to excellently transmit the heat, which is transmitted from the core to the inner mold part, to the housing. Accordingly, the durability and the heat releasing property of the core of the noise filter part can be further improved.

According to one or more embodiments, a connector can be provided in which a core for noise reduction is held without rattling, and which can be minimized.

Hereinbefore, the invention has been described simply. The invention will be clarified in detail when a mode (hereinafter, referred to as "embodiment") for carrying out the invention is described with reference to the drawings.

BRIEF DESCRIPTION OF THE DRAWINGS

FIG. 6A is a side view of the noise filter part, and FIG. 6B is a sectional view of the intermediate body of the connector when taken along the longitudinal direction, and FIG. 6C is a sectional view of the connector when taken along the longitudinal direction.

DETAILED DESCRIPTION

Hereinafter, an embodiment according to the invention will be described with reference to the drawings.

Figure 1:
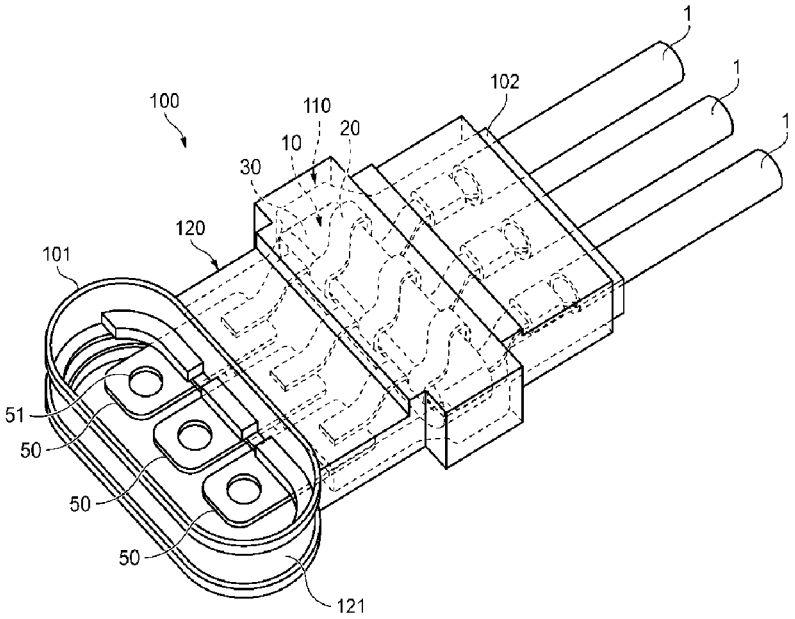
FIG. 1 is a transparent perspective view of a housing of a connector according to this embodiment.
Figure 2:
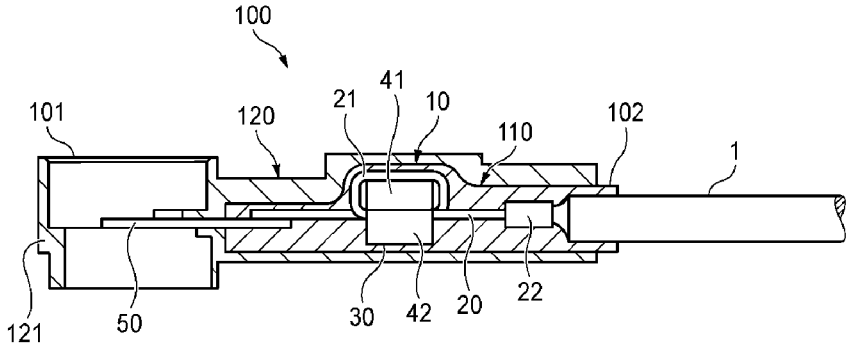
FIG. 2 is a sectional view of the connector according to this embodiment when taken along a longitudinal direction.
Figure 3:
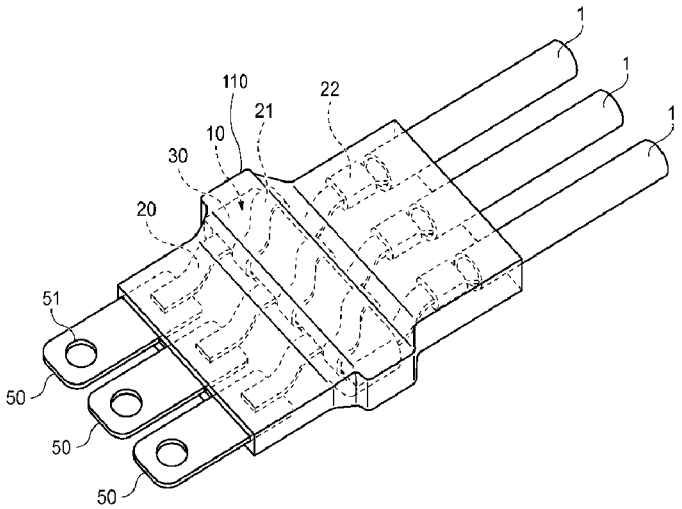
FIG. 3 is a perspective view of an intermediate body of the connector in a state where the housing is removed.

FIG. 1 is a transparent perspective view of a housing of a connector according to this embodiment. FIG. 2 is a sectional view of the connector according to this embodiment when taken along a longitudinal direction. FIG. 3 is a perspective view of an intermediate body of the connector in a state where the housing is removed.

As illustrated in FIGS. 1 and 2, a connector 100 according to this embodiment has a joint part 101 joined with a counterpart connector and a wire led-out part 102 in which a wire 1 of a wire harness is led out. The connector 100 includes an inner mold part 110 and a housing 120. The inner mold part 110 is covered with the housing 120. As illustrated in FIG. 3, the noise filter part 10 is provided in the inner mold part 110.

The connector 100 is provided in the wire harness which connects an inverter and a motor in an electric vehicle or a hybrid car, for example. The inverter converts a direct current of a power supply such as a battery to an alternating current, and drives the motor which rotates a wheel. The inverter converts the direct current at high speed to the alternating current by switching. Thus, a surge current of high frequency generated by switching flows as a noise to the wire of the wire harness. In the connector 100, the noise filter part 10 is provided in the wire harness which connects the inverter and the motor, so as to reduce the noise generated by switching.

Figure 4:
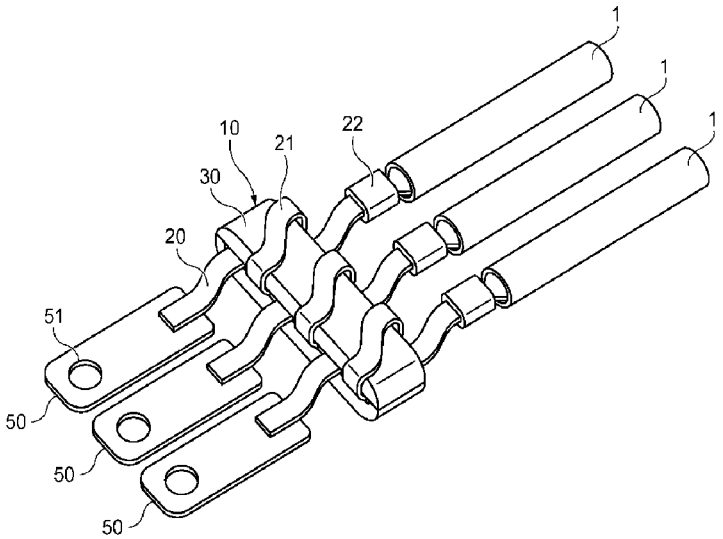
FIG. 4 is a perspective view of a noise filter part in a state where an inner mold part is removed.
Figure 5:
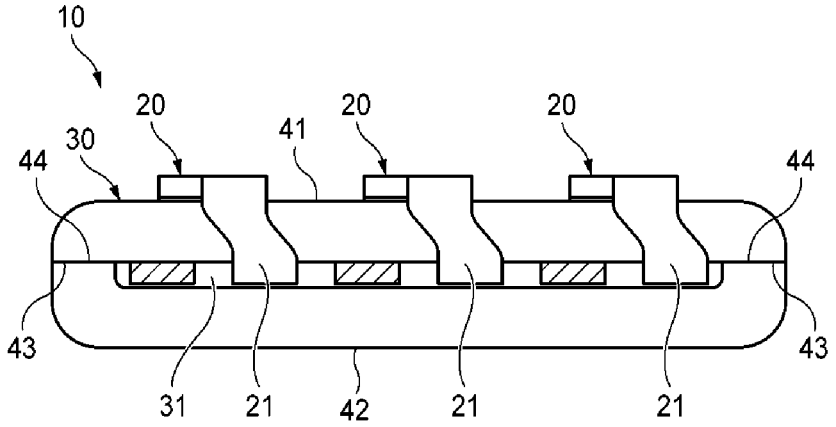
FIG. 5 is a side view of the noise filter part.

FIG. 4 is a perspective view of the noise filter part in a state where the inner mold part is removed. FIG. 5 is a side view of the noise filter part.

As illustrated in FIGS. 4 and 5, the noise filter part 10 has a plurality of (three in this example) conductors 20 and an annular core (core) 30.

The conductor 20 is formed of a planar bus bar, and is formed in a strip shape by performing a punching process and the like on a conductive metal plate. In the conductor 20, an intermediate part is wound in an annular shape by a bending process and the like, so as to be a winding part 21, and the winding part 21 is wound to project upward. The winding part 21 is inclined obliquely in plan view. Accordingly, the positions of both end portions of the winding part 21 are deviated in plan view, so that both end portions are separated so as not to contact each other.

The annular core 30 is formed of a magnetic member such as a ferrite. The annular core 30 is formed in a flat annular shape having an insertion hole 31 as a long hole. The insertion hole 31 of the annular core 30 has a height dimension slightly larger than the thickness of the conductor 20.

The annular core 30 is formed of a pair of division cores 41 and 42. The division cores 41 and 42 are arranged vertically, and are combined to each other to configure the flat annular core 30 having the insertion hole 31.

The division cores 41 and 42 are formed in a linear shape. The plurality of conductors 20 is arranged in a row in the wound state in one division core 41 arranged on the upper side. Further, the both end portions of the winding part 21 in each of the conductors 20 wound around the division core 41 is inserted into the insertion hole 31.

In one division core 41, the other division core side in both ends becomes a joint surface 43, and in the other division core 42, one division core 41 side in both ends becomes a joint surface 44. The both ends of the other division core 42 protrude to the one division core 41 side, and the end surface of the protruding portion becomes the joint surface 44.

The division cores 41 and 42 are joined with each other by allowing the joint surfaces 43 and 44 to abut to each other. The joint surfaces 43 and 44 are bonded and fixed by an adhesive member having a magnetic property. For example, the adhesive member is an adhesive material or an adhesive sheet which contains a magnetic material such as a ferrite powder. Accordingly, the joint surfaces 43 and 44 of the division cores 41 and 42 are fixed by the adhesive member having a magnetic property, so as to form the annular core 30 having an annular magnetic path.

In this manner, in the noise filter part 10 in which the plurality of conductors 20 are mounted in the annular core 30 formed of the pair of division cores 41 and 42, when the current flows in the conductor 20, the noise can be reduced by the annular core 30 having the annular magnetic path.

In the noise filter part 10, a terminal 50 having a bolt insertion hole 51 is fixed in one end side of each of the conductor 20. The terminal 50 is formed of a metal plate having a conductivity, and is connected in one end of the conductor 20, for example, by soldering. In addition, a crimping part 22 is provided in the other end side of each of the conductors 20, and the wire 1 of the wire harness is crimped and electronically connected in the crimping part 22.

The inner mold part 110 is formed of a soft resin material such as an elastomer, and is integrally molded around the noise filter part 10. In the noise filter part 10, the plurality of conductors 20, the annular core 30, the connection place with the conductor 20 in the terminal 50, and the connection place with the crimping part 22 of the conductor 20 in the wire 1 are covered with the inner mold part 110.

The housing 120 is formed of a hard resin material such as a plastic, and is integrally molded around the inner mold part 110. In the inner mold part 110, the entire outer circumference except an end portion where the wire 1 is led out is covered with the housing 120. The housing 120 has a cylindrical part 121 serving as the joint part 101, and the end part which is formed with the bolt insertion hole 51 of the terminal 50 connected in the conductor 20 is exposed in the cylindrical part 121.

Next, the description will be given about a case where the connector 100 is assembled.

Figure 6A:
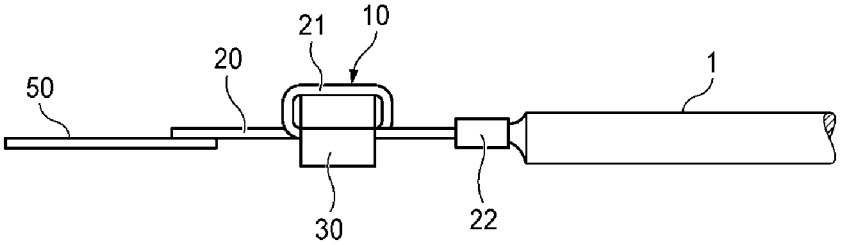
FIGS. 6A to 6C are views illustrating a manufacturing procedure of the housing.
Figure 6B:
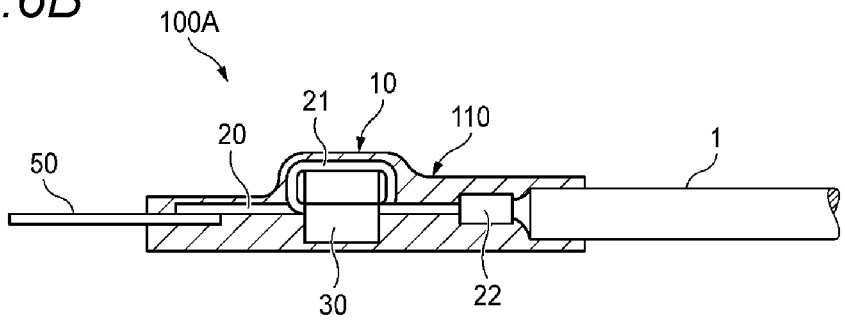
Figure 6C:
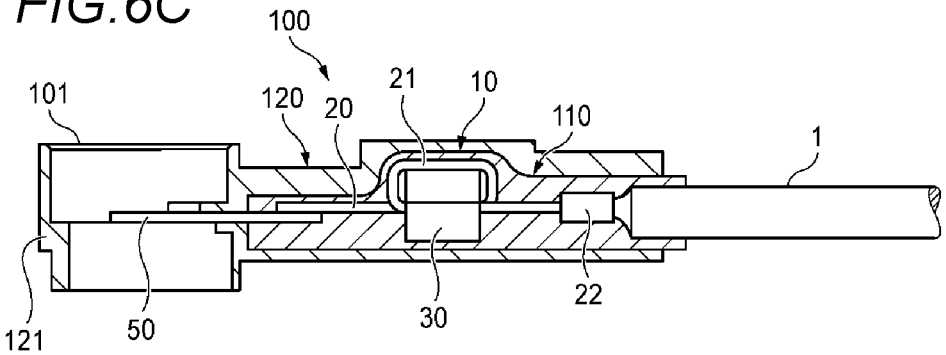

FIGS. 6A to 6C are views illustrating a manufacturing procedure of the housing. FIG. 6A is a side view of the noise filter part, and FIG. 6B is a sectional view of the intermediate body of the connector when taken along the longitudinal direction, and FIG. 6C is a sectional view of the connector when taken along the longitudinal direction.

As illustrated in FIG. 6A, the noise filter part 10 is assembled, the terminal 50 is fixed in one end of the conductor 20 of the noise filter part 10, and the crimping part 22 of the other end of the conductor 20 is crimped and connected to the end part of the wire 1.

First, the plurality of conductors 20 having the winding part 21 are provided in order to assemble the noise filter part 10. Further, in the conductors 20 having a posture where the winding part 21 is directed upward, one division core 41 is inserted into the winding parts 21, so as to become in a state where the conductors 20 wind the division core 41 and are arranged in a row. Thereafter, the joint surfaces 43 and 44 of the division cores 41 and 42 abut to each other and are joined by the adhesive member.

Next, as illustrated in FIG. 6B, in the noise filter part 10, the inner mold part 110 is integrally molded to cover the plurality of conductors 20, the annular core 30, the connection place between the terminal 50 and the conductor 20, and the connection place between the wire 1 and the crimping part 22 of the conductor 20. Specifically, the place where the inner mold part 110 is molded in the noise filter part 10 is arranged in a cavity of an inner mold part molding die (not illustrated), the cavity is filled with a molten soft resin material, and the resin material is removed from the inner mold part molding die after the curing of the resin material.

In this manner, the intermediate body 100A of the connector 100 is obtained in which the plurality of conductors 20, the annular core 30, the connection place between the terminal 50 and the conductor 20, and the connection place between the wire 1 and the crimping part 22 of the conductor 20 in the noise filter part 10 are covered with the molded inner mold part 110 which is formed of a soft resin material.

Thereafter, as illustrated in FIG. 6C, the housing 120 is integrally molded to cover the entire outer circumference of the intermediate body 100A except the end part where the wire 1 is led out. Specifically, the place of the intermediate body 100A where the housing 120 is molded is arranged in the cavity of a housing molding die (not illustrated), the cavity is filled with a molten hard resin material, and the resin material is removed from the housing molding die after the curing of the resin material.

In this manner, the connector 100 is obtained in which the entire outer circumference of the intermediate body 100A except the end part where the wire 1 is led out is covered with the molded housing 120 which is formed of a hard resin material.

In the above-described connector 100, the joint part of the counterpart connector is fitted into the joint part 101. Further, a screw (not illustrated) which is inserted into the bolt insertion hole 51 of the terminal 50 exposed in the cylindrical part 121 of the joint part 101 is screwed to the terminal of the counterpart connector, and the terminal 50 of the connector 100 is fastened and fixed in the terminal of the counterpart connector and is electronically connected. Accordingly, the noise generated in the inverter by the high-speed switching is reduced by the noise filter part 10 of the connector 100.

As described above, according to the connector 100 according to this embodiment, the noise of the current flowing in the conductor 20 can be reduced by the annular core 30 formed of the magnetic member of the noise filter part 10. The inner mold part 110 formed of a soft resin material is integrally molded to cover at least a periphery of the annular core 30 of the noise filter part 10, and further the periphery is covered with the housing 120 formed of a hard resin material. Thus, it is possible to prevent the rattling of the annular core 30 formed of a magnetic member, and further to suppress the transmission of the external force to the annular core 30. Accordingly, the impact resistance of the annular core 30 can be improved, and the durability with respect to the vibration or the impact during travelling and the like can be improved although the connector 100 is mounted in the vehicle. In addition, since the noise filter part 10 is covered with the inner mold part 110 by the integral molding, the minimization can be achieved compared to a structure which is mounted with the inner housing molded separately. Further, since the inner mold part 110 is brought into close contact with the annular core 30 by the integral molding, the heat of the annular core 30 can be excellently transmitted to the inner mold part 110, so as to improve the heat releasing property. In addition, since the inner mold part 110 is a soft resin material, the mold pressure during the integral molding can be suppressed to alleviate the stress applied to the annular core 30 during molding.

In this embodiment, the division core 41 formed in a linear shape pass through the winding parts 21 of the plurality of conductors 20, and the division cores 41 and 42 are combined with each other. Thus, the plurality of conductors 20 can be easily mounted in the annular core 30 having an annular shape, so as to improve an assembly workability. Further, since the conductors 20 are configured to be arranged in a row in the linear division core 41, a reduction in height can be achieved, so that the conductors can be installed in a narrow space.

In addition, in this embodiment, since the housing 120 is integrally molded to cover the periphery of the inner mold part 110, it is possible to prevent the rattling of the inner mold part 110 with respect to the housing 120, and further to excellently transmit the heat, which is transmitted from the annular core 30 to the inner mold part 110, to the housing 120. Accordingly, the durability and the heat releasing property of the annular core 30 of the noise filter part 10 can be further improved.

Incidentally, the invention is not limited to the above-described embodiments, and a modification, a variation or the like is allowed as appropriate. In addition, material, shape, size, number, location, or the like of each component in the above-described embodiments are arbitrary and not limited as long as they can attain the invention.

For example, in the connector 100 according to the above-described embodiment, the housing 120 is formed by the integral molding. However, the housing 120 may be not necessarily molded integrally. For example, the housing 120 is configured in a halved shape, and the halved housing 120 may be mounted in the intermediate body 100A integrally molded with the inner mold part 110 to cover the inner mold part 110.

The conductor 20 of the noise filter part 10 is not limited to the bus bar. For example, the conductor may be an insulation wire in which a core wire is covered with an outer coat.

In the annular core 30, at least one division core 41 passing through the winding part 21 of the conductor 20 may have a linear shape, and the lower division core 42 is not necessarily a linear shape and may have a curved shape.

Herein, the features of the embodiments of the connector according to the invention will be simply summarized as follows [1] to [3].

[1] A connector (100) comprising:

a conductor (20);

a noise filter part (10);

an inner mold part (110); and a housing (120), wherein the conductor (20) has a terminal (50) at one end and the other end of the conductor (20) is connected to a wire (1);

wherein the connector (100) is to be joined with a counterpart connector so that the terminal (50) is in conduction with a terminal of the counterpart connector, wherein the noise filter part (10) includes a core (annular core 30) attached to the conductor (20) and formed of a magnetic member which reduces noise of a current flowing in the conductor (20), wherein the inner mold part (110) is integrally molded with the noise filter part (10) so as to cover at least a periphery of the core (annular core 30) and formed of a soft resin material, and wherein the housing (120) which covers a periphery of the inner mold part (110) and is formed of a hard resin material.

[2] The connector according to [1], wherein the core (annular core 30) includes a pair of division cores (41, 42) having an annular shape, wherein joint surfaces (43, 44) of both ends of the pair of division cores (41, 42) are joined and combined with each other, wherein the conductor (20) has a winding part (21), and wherein one of the pair of division cores (41) has a linear shape and passes through the winding parts (21) and is provided with the conductors (20) arranged in a row.

[3] The connector according to [1] or [2], wherein the housing (120) is integrally molded with the inner mold part so as to cover the periphery of the inner mold part (110).

DESCRIPTION OF REFERENCE NUMERALS AND SIGNS

1: wire
10: noise filter part
20: conductors
21: winding part
30: annular core
41, 42: division core
43, 44: joint surface
50: terminal
100: connector
110: inner mold part
120: housing

What is claimed is:

1. A connector comprising:
a conductor;
a noise filter part;
an inner mold part; and
a housing,
wherein the conductor has a terminal at one end and the other end of the conductor is connected to a wire;
wherein the connector is to be joined with a counterpart connector so that the terminal is in conduction with a terminal of the counterpart connector,
wherein the noise filter part includes a core attached to the conductor at an attachment portion and formed of a magnetic member which reduces noise of a current flowing in the conductor,
wherein the inner mold part is integrally molded around the noise filter part so as to be brought into contact with and cover at least an entire periphery of the core and the attachment portion of the conductor and formed of a soft resin material,
wherein the housing which covers a periphery of the inner mold part and is formed of a hard resin material, and
wherein the inner mold part extends onto and covers the terminal, wherein the conductor has a winding part, and
wherein the core has a portion that passes through the winding parts and is provided with the conductors arranged in a row.

2. The connector according to claim 1,
wherein the core includes a pair of division cores having an annular shape,
wherein joint surfaces of both ends of the pair of division cores are joined and combined with each other wherein the conductor has a winding part,
wherein the conductor has a winding part, and
wherein one of the pair of division cores has a linear shape and passes through the winding parts and is provided with the conductors arranged in a row.

3. The connector according to claim 1,
wherein the housing is integrally molded with the inner mold part so as to cover the periphery of the inner mold part.

4. The connector according to claim 3,
wherein the housing is integrally molded around the inner mold part so as to be brought into contact with and cover at least an entire periphery of the inner mold part.

5. The connector according to claim 1,
wherein the inner mold part is an elastomer.

6. The connector according to claim 5,
wherein the housing is a plastic.

7. A connector comprising:
a conductor;
a noise filter part;
an inner mold part; and
a housing,
wherein the conductor has a terminal at one end and the other end of the conductor is connected to a wire;
wherein the connector is to be joined with a counterpart connector so that the terminal is in conduction with a terminal of the counterpart connector,
wherein the noise filter part includes a core attached to the conductor and formed of a magnetic member which reduces noise of a current flowing in the conductor,
wherein the inner mold part is integrally molded with the noise filter part so as to cover at least a periphery of the core and formed of a soft resin material,
wherein the housing which covers a periphery of the inner mold part and is formed of a hard resin material,
wherein the core has an annular shape and the conductor passes through the core, and
wherein the conductor includes a crimping part at the other end that is crimped onto the wire and the inner mold part extends onto and covers the crimping part, wherein the conductor has a winding part, and
wherein the core has a portion that passes through the winding parts and is provided with the conductors arranged in a row.

* * * * *